US009456957B2

(12) United States Patent
Tahil et al.

(10) Patent No.: US 9,456,957 B2
(45) **Date of Patent: *Oct. 4, 2016**

(54) DEVICE FOR FILLING SOLUBLE CONTAINERS

(75) Inventors: Raj Vikram Tahil, Maharashtra (IN); Santosh Puransingh Bhagat, Maharashtra (IN); Ajay Virendra Mistry, Maharashtra (IN)

(73) Assignee: Raj Vikram Tahil, Maharashtra (IN)

( * ) Notice: Subject to any disclaimer, the term of this patent is extended or adjusted under 35 U.S.C. 154(b) by 647 days.

This patent is subject to a terminal disclaimer.

(21) Appl. No.: 13/544,676

(22) Filed: Jul. 9, 2012

(65) Prior Publication Data

US 2013/0014471 A1 Jan. 17, 2013

(30) Foreign Application Priority Data

Jul. 11, 2011 (IN) ..... 1988/MUM/2011

(51) Int. Cl.
*A61J 3/07* (2006.01)

(52) U.S. Cl.
CPC ..... *A61J 3/072* (2013.01); *A61J 3/074* (2013.01); *A61J 3/075* (2013.01)

(58) Field of Classification Search
CPC ..... A61J 3/07; A61J 3/071; A61J 3/072; A61J 3/074; A61J 3/075
USPC ..... 53/900, 390, 281, 235, 246, 381.1, 53/381.4
See application file for complete search history.

(56) References Cited

U.S. PATENT DOCUMENTS

| | | | | |
|---|---|---|---|---|
| 5,321,932 | A * | 6/1994 | Sundberg | 53/468 |
| 5,836,141 | A * | 11/1998 | Sundberg | 53/468 |
| 7,234,494 | B2 * | 6/2007 | Tahil et al. | 141/237 |
| 7,337,596 | B2 * | 3/2008 | Barrett et al. | 53/531 |
| 2013/0032246 | A1 * | 2/2013 | Tahil et al. | 141/98 |

* cited by examiner

*Primary Examiner* — Andrew M Tecco
*Assistant Examiner* — Praachi M Pathak
(74) *Attorney, Agent, or Firm* — Brinks Gilson & Lione

(57) ABSTRACT

A device for filling soluble containers is provided. The device includes an assembly for orienting a plurality of capsules having at least one sheet component for orienting capsules and at least one base component for guiding the oriented capsules to a following assembly. The assembly for orienting capsules can be adapted to a hand-held assembly for filling capsules or to a bench-top assembly for filling capsules. The assembly for filling capsules may further include a capsule-loading tray and a locking plate.

12 Claims, 23 Drawing Sheets

DEVICE FOR FILLING SOLUBLE CONTAINERS

CROSS-REFERENCE TO RELATED APPLICATIONS

This application claims priority to India Patent Application No. 1988/MUM/2011, filed on Jul. 11, 2011, the entirety of which is hereby incorporated by reference.

FIELD OF THE INVENTION

The present invention relates to the field of filling soluble containers such as capsules by conventionally orienting the capsules, opening the cap of the capsules for filling required contents into the capsule bodies thereafter re-closing the filled capsules.

BACKGROUND

Generally, it is known that a device for filling soluble containers such as capsules includes an orienter, a filler and accessories such as a powder tray and a powder spreader. The devices known in the art can be a hand-held device or a bench top device. The hand held device is generally used for small volume filling of capsules and the bench top device is generally used when a greater volume of capsules are to be filled.

U.S. Pat. No. 7,234,494 discloses a hand held device for filling soluble containers, wherein the device for filling soluble containers includes an assembly for orienting and separating capsules and an assembly for filling the capsules. The U.S. Pat. No. 7,234,494 discloses an assembly for orienting capsules having a sheet component for orienting capsules and a base component for guiding the oriented capsules. The sheet component has a top sheet for loading the capsules and a bottom sheet for orienting the capsules loaded therein and the sheets capable of being relatively displaced with respect to each other. Slots are provided in the top sheet for limiting such displacement by setting free configuration for orientation of the capsules. The U.S. Pat. No. 7,234,494 further describes that an open closable gate is mounted to the top sheet for enabling easier loading and containment of the capsules within the top sheet, for orienting the capsules. The sheet component is usually configured as a sub-assembly and is capable of being used as a change-part in pre-assembled condition.

Typically, the sheet component is fitted to the orienter base using a screw. Therefore, each time, the size of the capsules to be filled is changed, the change-part is unscrewed from the orienter base and another change-part according to the required size is re-screwed to the orienter base. This can be a tedious process and can also add time to the time cycle of the capsule filling process thereby decreasing the efficiency of the capsule-filling machine.

U.S. Pat. No. 7,234,494 further discloses a hand held filler assembly having a sheet component with a top sheet, bottom sheet and a sliding sheet and each of the sheets having plurality of holes therein to allow passage of capsules therethrough for holding the capsules for facilitating separation into the body portion and the cap portion. Further, it has been disclosed that the sliding sheet can be displaceable relative to the top and bottom sheets for effecting gripping of a portion of the capsules during separation of the capsules. Further, the base component has a cam assembly mounted on it for effecting relative displacement of the sheets.

The sheet components may have to be assembled one by one on to the filler base component that may increase the cycle time in a hand held filler assembly.

Bench top fillers known in the art generally include a base frame assembly having a locking lever handle with gear mechanism to get the mechanical advantage for locking the capsules, a tamper assembly, locking plate and optionally a vibrator for faster filling of powder with minimal weight variation. Generally, the capsule-loading tray is securely placed on the bench top filler and the capsule is separated into a capsule body portion and a capsule cap portion. The cap portion is removed from the filler along with the capsule-loading tray. The capsule body portion left open in the filling position is filled with the predetermined quantity of the powder medicament. Tamping can be done which helps in filling more powder in each capsule with uniform fill weight. Then the capsule-loading tray with the caps is replaced on the filler and the caps are locked to the body of the capsules using locking plate.

It is known in the art that the change parts in a hand-held filler assembly or a bench-top filler assembly for filling capsules of different sizes include capsule loading tray and sheet component. However, the change parts are dedicated to a hand held device or a bench top device. The change parts known in the art are not adapted to be used on both hand-held and the bench-top device.

It is an object of the present invention to provide an improved device for orienting and filling capsules. It is another object of the present invention to provide a device for filling capsules with interchangeable change parts and interchangeable Handheld Orienter or interchangeable Benchtop Orienter that can be used in a hand-held filling machine and a bench top manual capsule-filling machine and facilitating upgrade of a hand-held filling machine to a benchtop filling machine.

SUMMARY OF THE INVENTION

In one embodiment of the present invention, a device for filling soluble containers is provided, said device including an assembly for orienting a plurality of capsules; an assembly for filling capsules; said assembly for orienting capsules having at least one sheet component for orienting capsules and at least one base component for guiding the oriented capsules therethrough to a following assembly; said sheet component having at least one first sheet and at least one second sheet; said sheets being set apart and capable of being displaced relatively to each other; said first sheet having a plurality of ribs provided individually at least in three out of four side edges of the sheet and a plurality of notches for accommodating the capsules loaded thereto, in coordination with said second sheet; said second sheet having a plurality of notches adapted to substantially orient the capsules into filling position, the assembly for orienting capsules has at least one displacement limitation means in at least one side of said sheets, said displacement means including at least one slot for sliding, said slot located in at least a first sheet or in at least a second sheet or in combination thereof, and a screw extending from said slot to limit relative displacement of said first sheet with respect to said second sheet; wherein said sheet component is provided with a screw bush having a groove at the bottom to enable mounting said sheet component over said base component; wherein said base component comprises screw bush locating hole for holding said screw bush and a snap-fit arrangement mounted on the surface of said base component to lock the sheet component to the base component, said snap-fit arrangement comprises a sliding latch mounted on the surface of the base component and fastened to a resilient means, such that the sliding latch engages the groove on the screw bush locking the sheet component to the base component.

The sliding latch of the snap-fit arrangement can be mounted on the base component by a mounting screw and can be provided with a slot at a position corresponding to fastening location of mounting screw and can be dimensioned to enable horizontal sliding movement of the latch. The sliding latch has a cut profile to engage the groove on the screw bush. The resilient means can be a spring integrally mounted in a housing.

The base component further has locating holes at the bottom surface for supporting and locating the assembly for orienting capsules on capsule loading tray.

According to one embodiment of the invention, the assembly is a hand held orienter. The assembly for orienting capsules can be adapted to a hand-held assembly for filling capsules or to a bench-top assembly for filling capsules.

Another embodiment of the present invention provides a device for filling soluble containers having an assembly for orienting a plurality of capsules; an assembly for filling capsules; the assembly for filling capsules having a sheet component for holding a body portion of capsules thereby facilitating separation of a body portion and a cap portion of the capsules resulting in separated capsules, and a base component for supporting a body portion of the separated capsules. The sheet component has a top sheet and at least two sliding sheets, first sliding sheet located below the top sheet and adapted to move relative to the top sheet; and a second sliding sheet located below said first sliding sheet and adapted to move relative to the first sliding sheet; and each of said sheets having a plurality of holes therein to allow passage of capsules therethrough for holding a portion of each of the capsules for facilitating separation into the body portion and the cap portion. The top sheet can have a spacer with groove fastened on its bottom surface such that the sliding sheets move within the groove. The sheet component is provided with locating holes for locating and accommodating a capsule tray. The sheet component is fastened to the base component.

The base component has a displacement means for effecting relative movement of said sheets wherein the displacement means can be a cam assembly mounted to the base component.

In one embodiment of the present invention, the sheet component can be adapted for a hand held assembly for filling capsules. In another embodiment of the invention, the sheet component can be adapted for bench top assembly for filling capsules.

The assembly for filling capsules further includes a capsule-loading tray having holes to detachably attach a locating stud wherein the locating stud locates the holes provided on the assembly for orienting capsules. A detachable screw is provided to replace the locating stud for use of capsule loading tray on a benchtop orienter. The capsule-loading tray further includes lifting pins for locating holes provided on the sheet component of the assembly for filling capsules. According to the invention, the capsule-loading tray can be adapted to a hand held or a bench top assembly for orienting capsules and can be adapted to a hand held or a bench top assembly for filling capsules.

The assembly for filling capsules further includes a locking plate having plurality of domes on the bottom surface. The locking plate further includes a profile cut slot with step for locking the capsule loading tray that can lock the detachable locating studs of the capsule loading tray making it suitable for use in hand held filler assembly.

The present invention provides a bench top device for filling capsules including the sheet component and the capsule tray of the assembly for filling capsules according to the invention.

The bench top device according to the present invention further includes a self-locking "C" clamp for locking a tamper assembly and locking plate. The bench top device according to invention further includes a vibrator with a cover.

The present invention provides a device for filling soluble containers including a capsule counter. The capsule counter has a tray having compartments to hold pre-determined number of capsules, a door provided in front of each compartment, and the door open in to a chute for delivering the capsules to a container. The capsule counter can be adapted to the capsule tray assembly of the present invention.

DETAILED DESCRIPTION OF THE DRAWINGS

The present invention discloses a device for filling soluble containers such as capsules.

The device according to the present invention has an orienter assembly and a filler assembly and accessories including a powder tray and a tamper unit.

In one embodiment of the invention, the filler assembly includes a capsule loading tray assembly and sheet component that can be interchangeably used on a hand held filler and bench-top manual capsule-filling machine.

Generally, an orienter assembly can orient about 50 or more capsules at a time. The orienter assembly of the present invention can orient about 300 or more capsules in three stages in the same capsule-filling machine.

Figure 1:
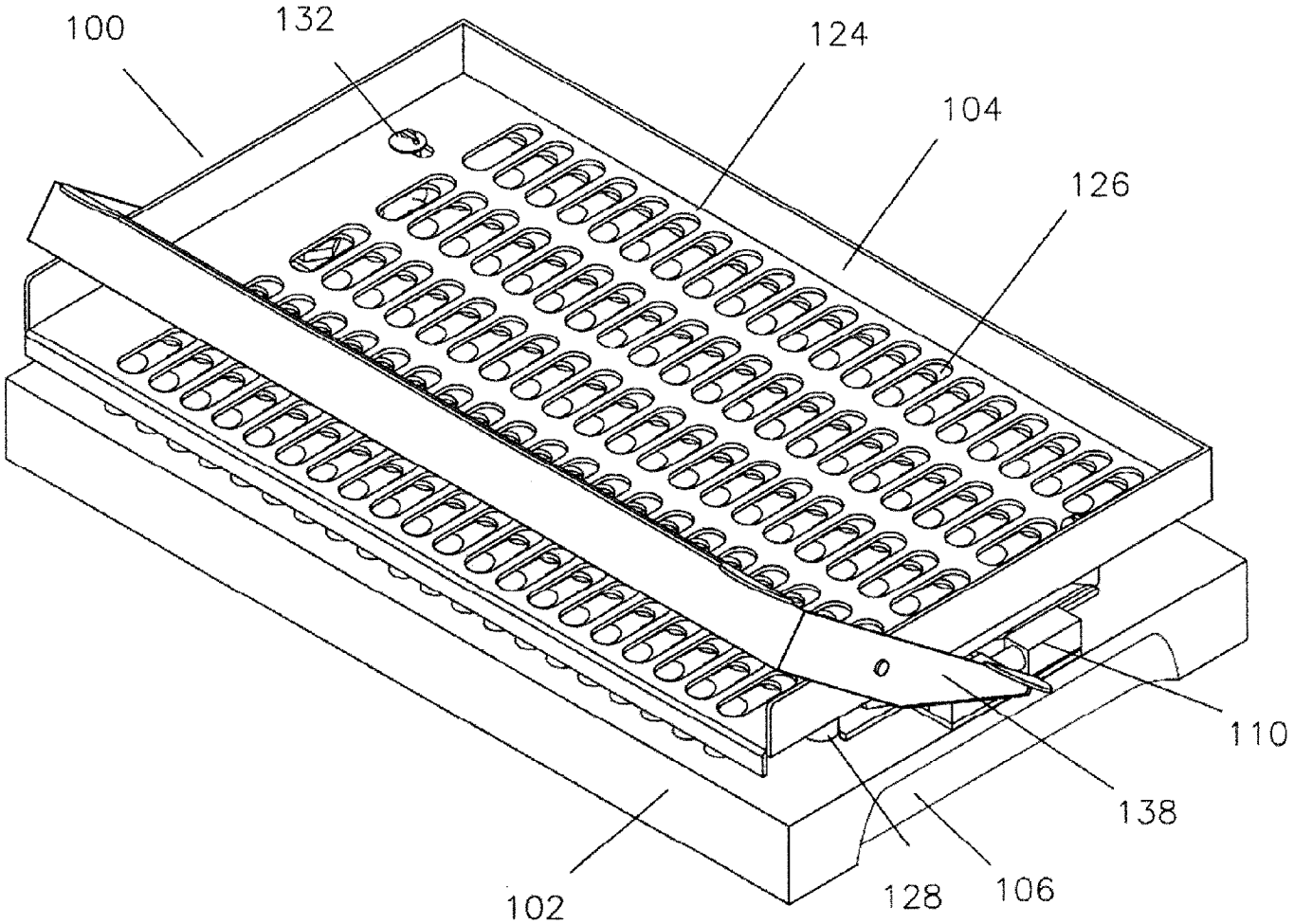
FIG. 1 shows an isometric view of an orienter assembly according to the present invention.

In one embodiment of the invention, FIG. 1 shows an assembly for orienting capsules (100). The orienter assembly (100) has a base component (102) and a orienter sheet component (104) that can be supported over the base component (102).

The orienter sheet component (104) has a orienter top sheet (124) and a orienter bottom sheet (126) assembled together using a set of screw bushes (128) having grooves (130) (FIG. 5C) and a set of top screws (132). The sheet component (104) can be snap-fitted over the base (102).

Figure 2:
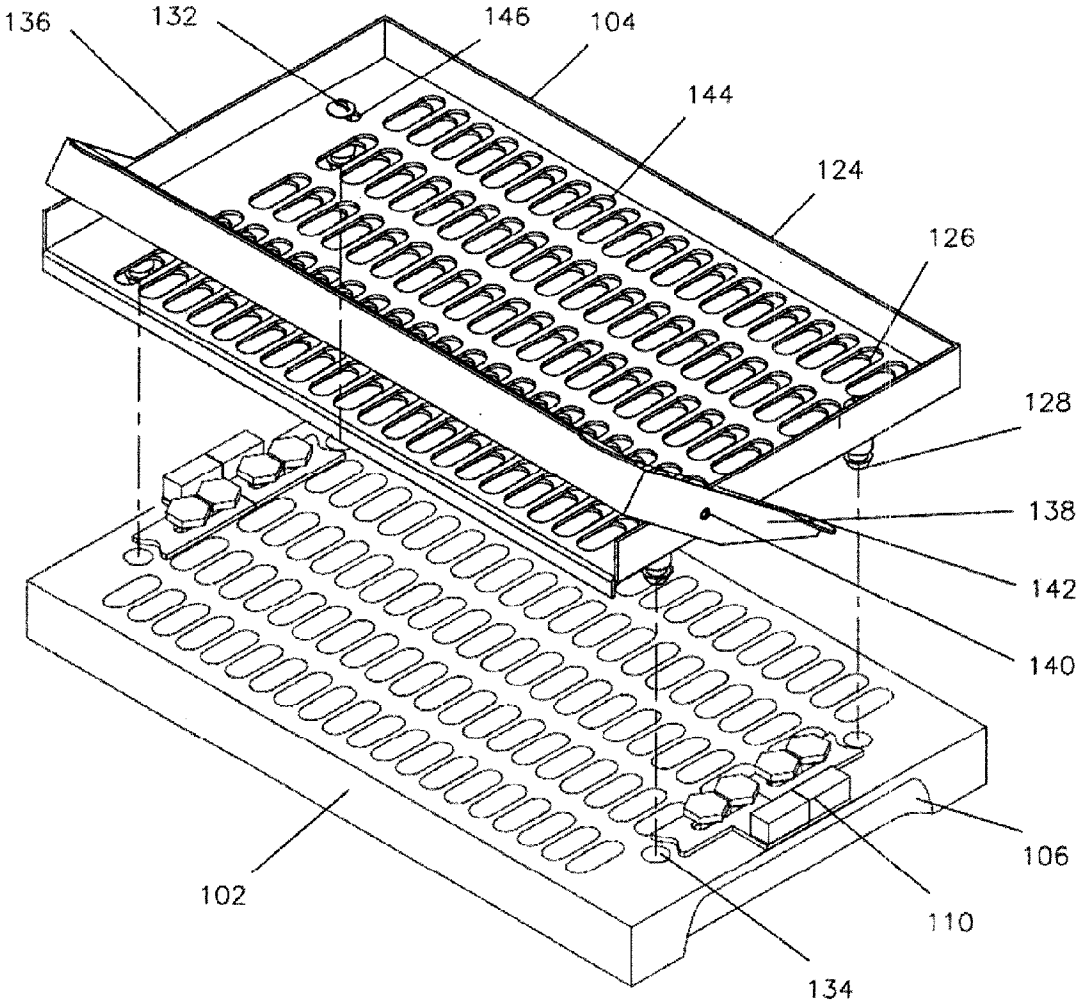
FIG. 2 shows an exploded view of an orienter assembly according to the present invention.
Figure 4:
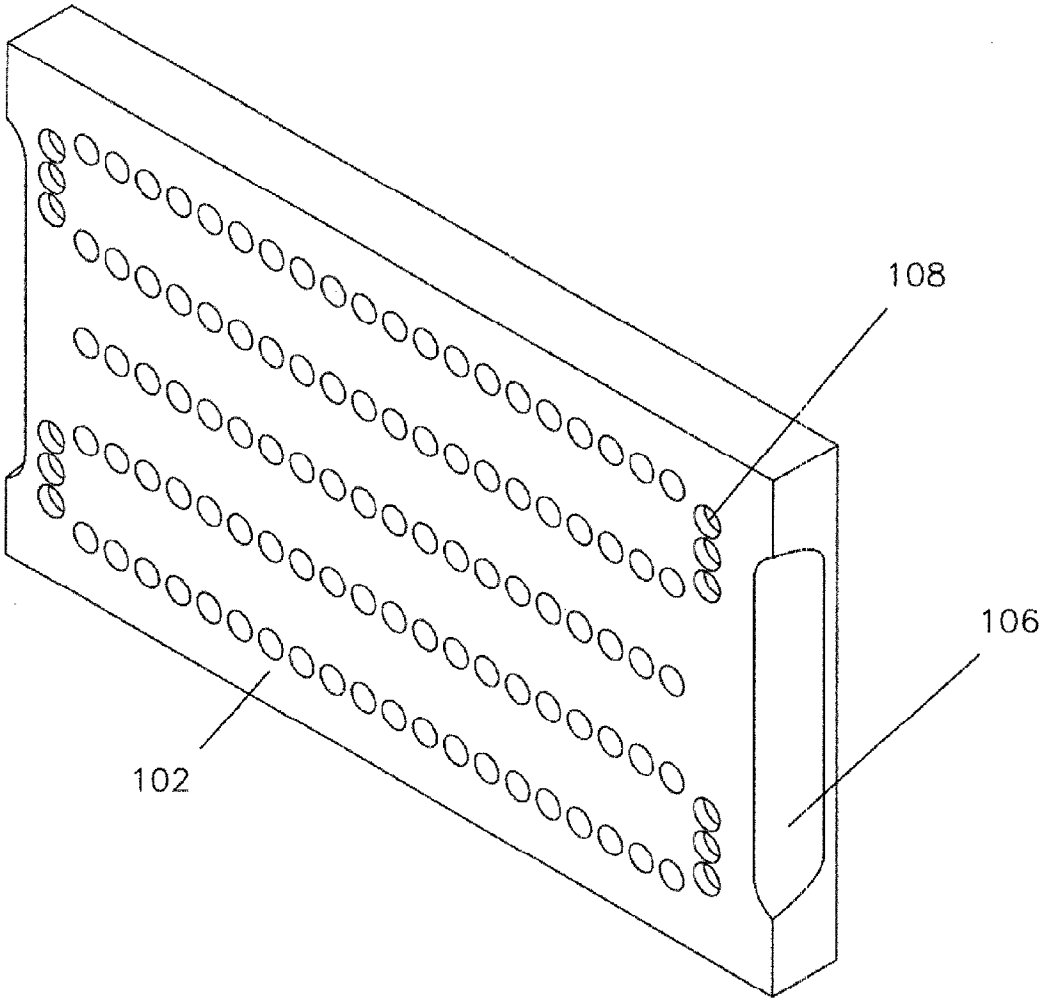
FIG. 4 shows a bottom view of an orienter base according to the present invention.

The base (102) can have a pair of cut-outs (106) for hand-gripping to facilitate holding of the orienter assembly by the operator (FIG. 2). The base (102) on its bottom surface has hollow locating holes (108) (FIG. 4) to enable positioning of the Orienter assembly over a capsule tray assembly on filler assembly. Preferably, the base (102) can have twelve locating holes for locating the assembly for orienting capsules (100) (FIG. 4). The assembly for orienting capsules (100) can be used on both hand-held and bench top manual capsule filling machines.

Figure 3:
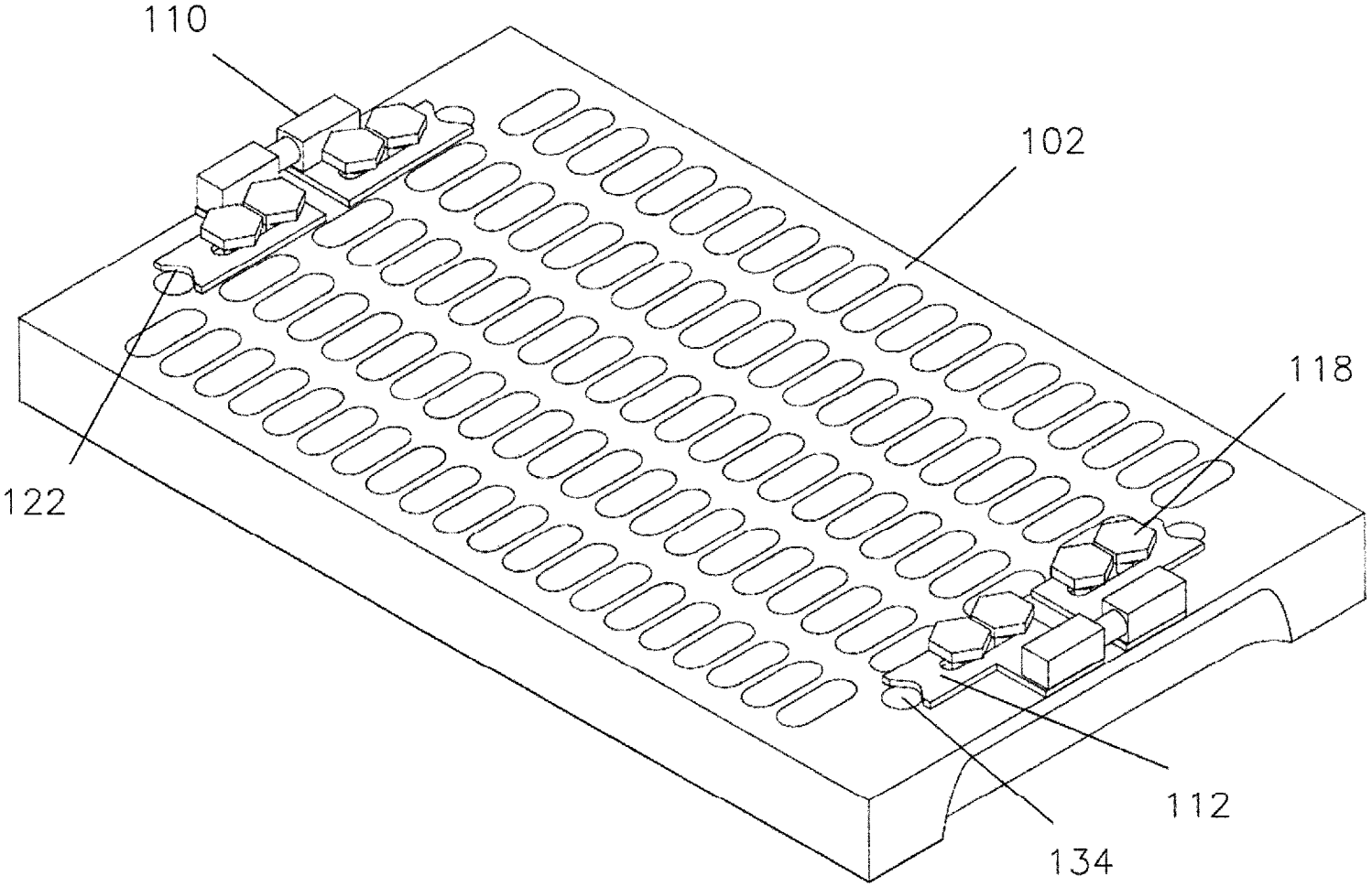
FIG. 3 shows a top view of an orienter base according to the present invention.
Figure 5A:
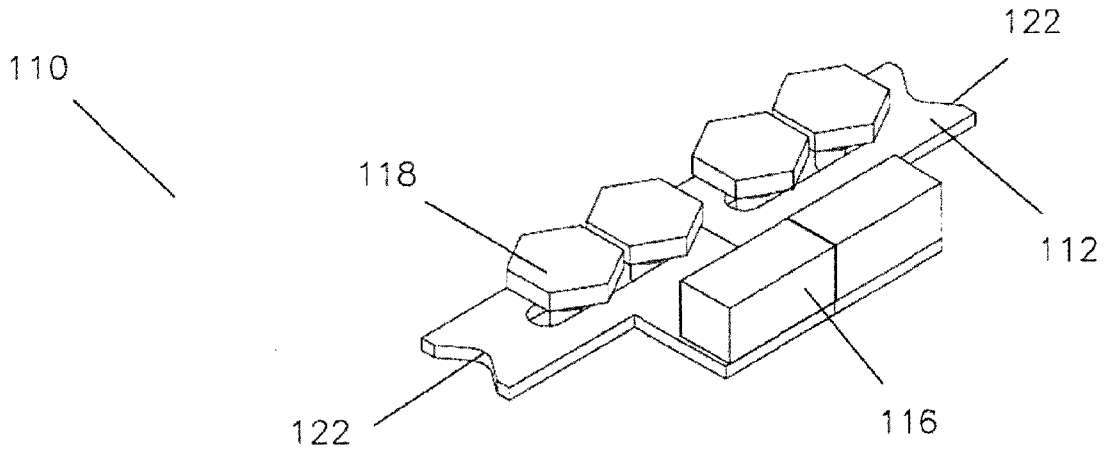
FIG. 5A shows a snap-fit arrangement according to the present invention.
Figure 5B:
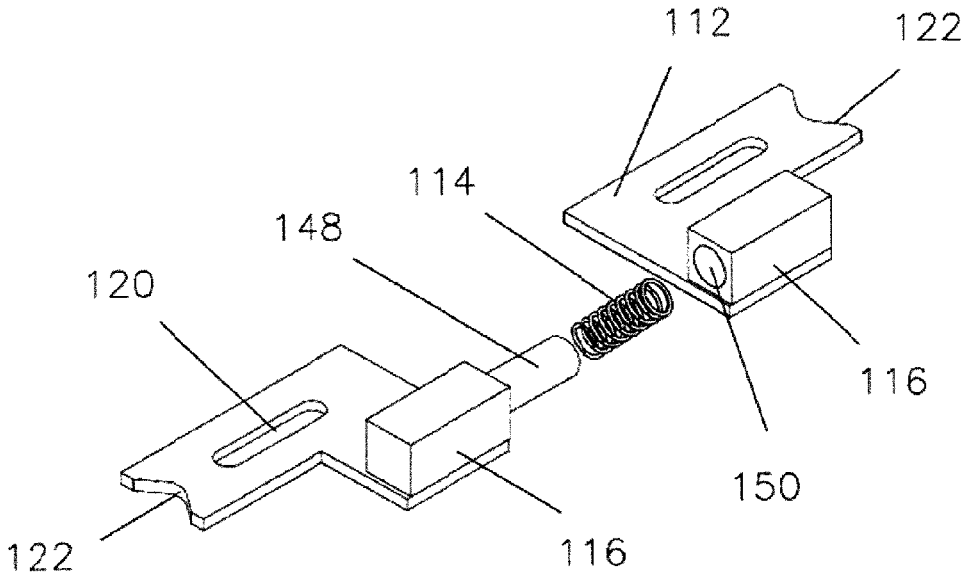
FIG. 5B shows an exploded view of the snap-fit arrangement of FIG. 5A.
Figure 5C:
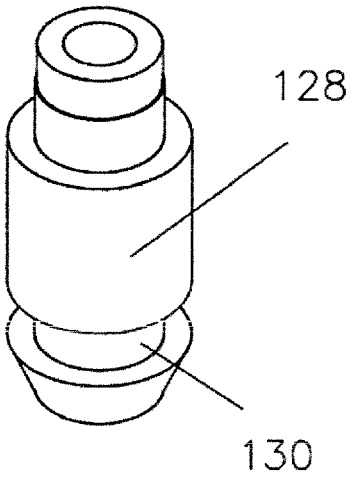
FIG. 5C shows a close up view of a screw bush of the present invention.

A snap-fit arrangement (110) can be mounted on the top surface of the base (102) (FIGS. 1 to 3). The snap-fit arrangement (110) can be suitably located on the top surface of the base (102) for holding and locking the orienter sheet component (104). FIG. 3 shows the snap-fit arrangement (110) having a sliding latch (112) mounted on the top surface of the base (102) with mounting screws (118) and fastened to a resilient means (114) (FIG. 5B). The base (102) further has screw bush locating hole (134) on the side of the sliding latch (112). The sliding latch (112) has a slot (120) at a position corresponding to fastening location of the mounting screws (118) and is dimensioned to enable horizontal sliding movement of the latch (FIG. 5B). The sliding latch (112) has a cut profile (122) to engage a screw bush groove (130) of the sheet component (104) (FIG. 5C). The resilient means (114) can be a spring, which can be integrally mounted in a spring housing (116). The spring housing (116) has two parts, one housing has shaft (148) and other has a hole (150), where the resilient means (114) can be inserted, compressed and released by sliding latch (112) along with spring housing (116) to enable horizontal sliding movement of the latch. The sliding latch (112) gets compressed so that the orienter screw bushes (128) having grooves (130) enter the screw bush locating holes (134) on the base (102) and the sliding latch (112) engage the groove (130) holding and locking the orienter sheet component (104) to the base (102). The operator can locate and press the orienter sheet component (104) to engage the groove (130) holding and locking the orienter sheet component (104) to the base (102) due to presence of resilient means (114). The snap-fit arrangement of the sliding latch (112) can be released by compressing the sliding latch (112) so that the sliding latch cut profile (122) disengages from screw bush groove (130) to freely remove the screw bush (128) from the screw bush locating holes (134) on the base (102). Thus, the snap-fit arrangement makes a tool free assembly of the orienter sheet component on the orienter base with reduced change over time of orienter change parts.

The orienter top sheet (124) has a tray type configuration and can be capable of accommodating about 100 or more capsules at a time (FIG. 2). A plurality of ribs (136) can be provided individually at least in three out of four side edges and a gate (138) may be disposed at one side edge of the top sheet (124) which can be open and which can be devoid of ribs (136). The gate (138) can be configured at the side edge where the rib (136) is not present and such side, when in capsule orienting position, can be towards the operator. The gate (138) can be fixed onto the ribs (136) as shown in FIG. 2 using a pair of pivot pins (140) so that the gate (138) can be movable vertically, preferably in a circular path about the pivot pins (140). The gate (138) can be opened and closed by the operator, by pushing the gate using thumbs. In one position whereby the operator lifts the gate (138), the gate (138) can be moved upwards whereby one side edge of the top sheet (124) can be open and in the normal position of the gate (138), the gate (138) remains at a lower position, enabling closure of the open side edge of the top sheet (124) due to the tare weight of the gate. This eliminates wastage of capsules falling out from the top sheet (124) due to accidental opening of the gate (138), during shaking of the orienter assembly (100).

The orienter top sheet (124) has a plurality of notches (144) (FIG. 2) each having substantially elliptical shape and such notches (144) are preferably configured in 100 or more in number as known to a person skilled in the art. The purpose of the orienter top sheet (124) can be to temporarily accommodate the capsules that are required to be filled with required contents and for transferring them onto the orienter bottom sheet (126) by passage of the capsules through the notches (144). Preferably, slots (146) are provided in the orienter top sheet (124), at positions corresponding to fastening location of the top screws (132). The slots (146) are dimensioned suitably to enable horizontal sliding movement of the orienter top sheet (124) relative to the position of the orienter bottom sheet (126).

The orienter top sheet (124) and the orienter bottom sheet (126) are separated vertically by a predetermined distance in-between so as to make the capsules sit perfectly in the notches (144) and to prevent them from coming out of the notches (144) during shaking of the orienter assembly. The distance between the orienter top sheet (124) and orienter bottom sheet (126) can be set between the optimum ranges known to a person skilled in the art.

The dimensions of the profile notch can be altered and varied as per the requirement as known to the person skilled in the art.

Another embodiment of the invention discloses a filler assembly (200) having a base frame (202) having a height adjustable lifting plate (204) and a sheet component (206) mounted on the base frame (202) (FIGS. 6, 6A-6C and 7). The sheet component (206) holds the bottom body portion of capsules facilitating separation of a body portion and a cap portion of the capsules resulting in separated capsules. The lifting plate (204) supports the body portion of the separated capsules. The filler assembly (200) further includes capsule loading tray (300) and a locking plate (302).

Figure 8A:
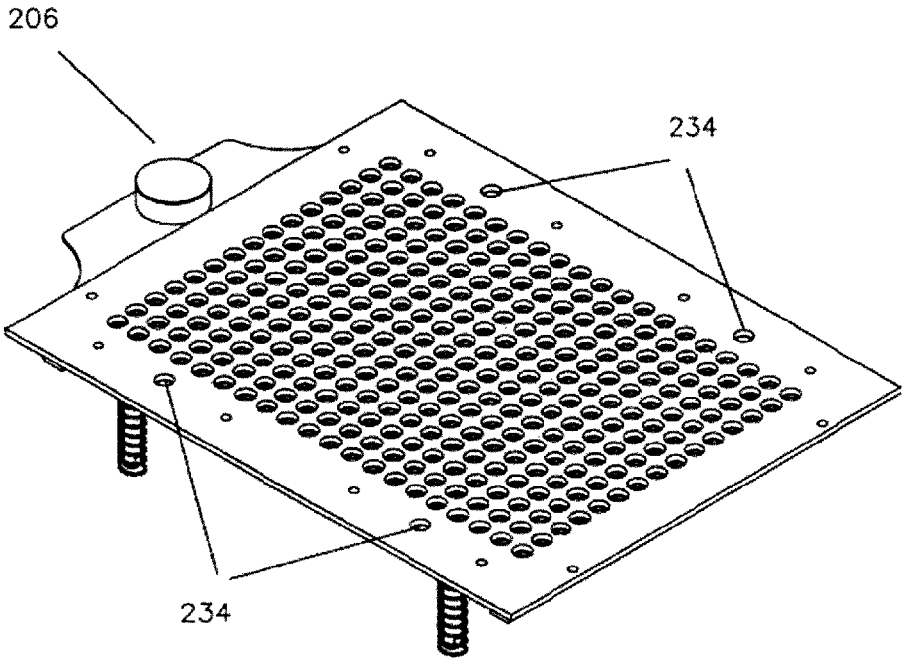
FIG. 8A shows a sheet component of the filler assembly according to the present invention.
Figure 8B:
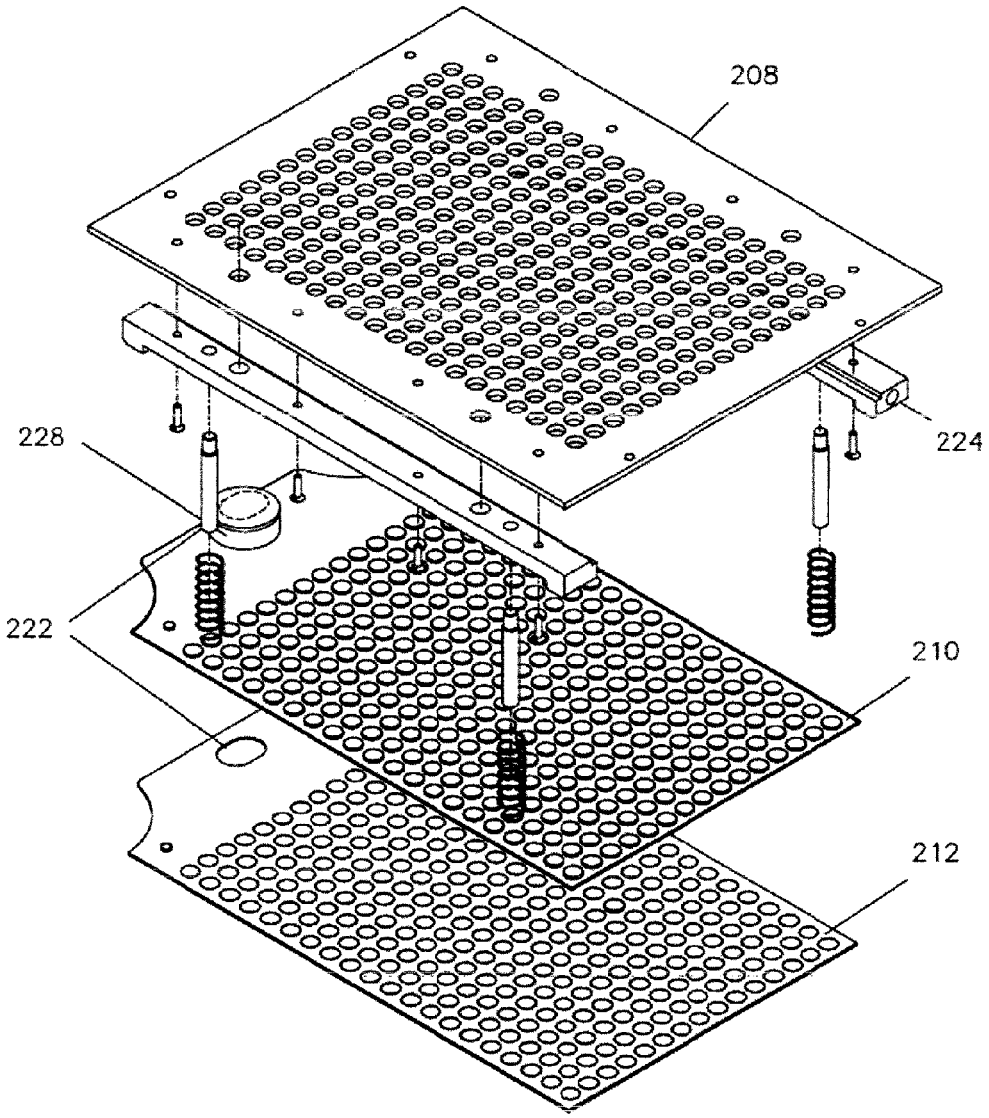
FIG. 8B shows an exploded view of the sheet component of FIG. 8A.
Figure 8C:
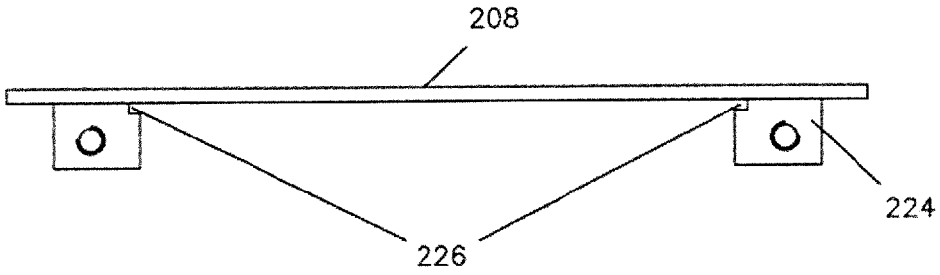
FIG. 8C shows a side view of the sheet component of FIG. 8A.

FIGS. 8A-8C show the sheet component (206) having a top sheet (208) and two sliding sheets (210) and (212), first sliding sheet (210) located below the top sheet (208) which can be adapted to move relatively to the top sheet (208) and a second sliding sheet (212) located below the first sliding sheet (210) adapted to move relatively to the first sliding sheet (210). The number of sliding sheets (210 and 212) can be increased for separating and filling more number of capsules. Each of the sheet components (208, 210 and 212) can have plurality of holes therein to allow passage of capsules therethrough for holding a portion of each of the capsules for facilitating separation into a body portion and cap portion. The diameter of the holes can be such that the clearance between capsule body outer diameter and hole internal diameter is kept minimum and each hole in the sheet components (208, 210, and 212) should be concentric to each other. The diameter of the holes is preferably kept in lower diameter to avoid defects of telescoping or overlapping.

The top sheet (208) can have a spacer sheet (224) having spacer grooves (226) fastened to the bottom surface of the top sheet (208) thereby providing a gap between the top sheet (208) and the sliding sheets (210 and 212) enabling the relative movement of the sliding sheets (210 and 212) through the spacer groove (226) on the bottom surface of the top sheet (208). An advantage of the present invention is easy cleaning of the sheet component as it does not include a bottom sheet.

Figure 9A:
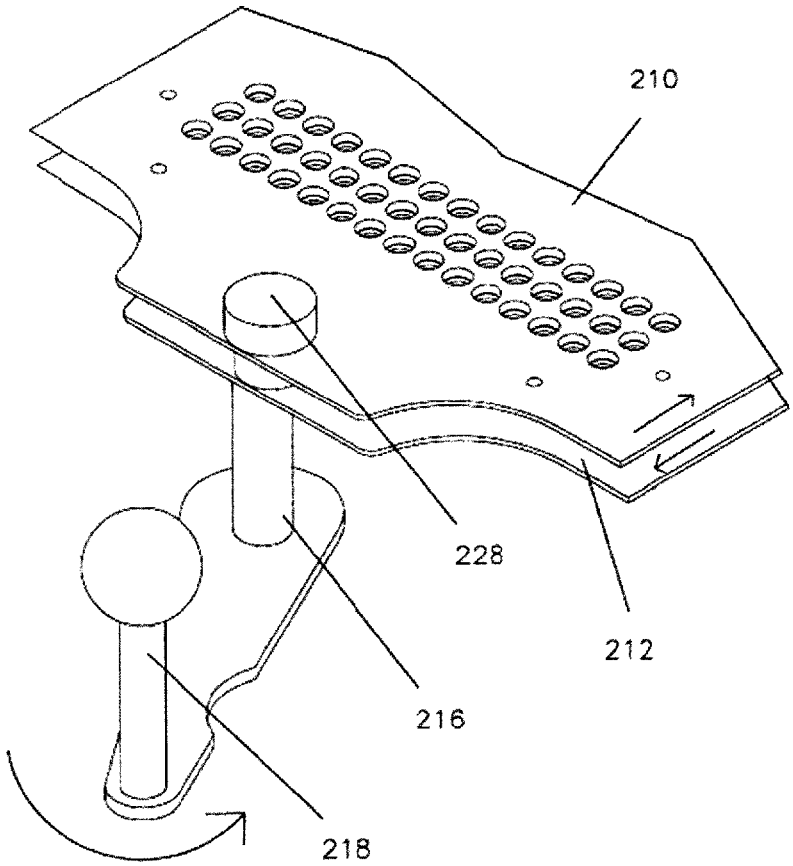
FIG. 9A shows the front view of the cam and sliding plate arrangement.

The base frame (202) has a cam support block (214) (FIG. 7) having a cam (216) and an integral cam handle (218). The cam (216) can be mounted at one edge of the base frame (202). A cam slot (222) can be provided in the sliding sheets (210) and (212) in engagement with the cam (216) such that when the operator operates the cam (216) by turning the cam handle (218), the engagement of the cam (216) with the sliding slot (222), the first sliding sheet (210) can be relatively moved along the horizontal direction, with respect to the top sheet (208) and the second sliding sheet (212) can be relatively moved along the horizontal direction with respect to the first sliding sheet (210) as shown in FIGS. 9A and 9B.

Figure 9B:
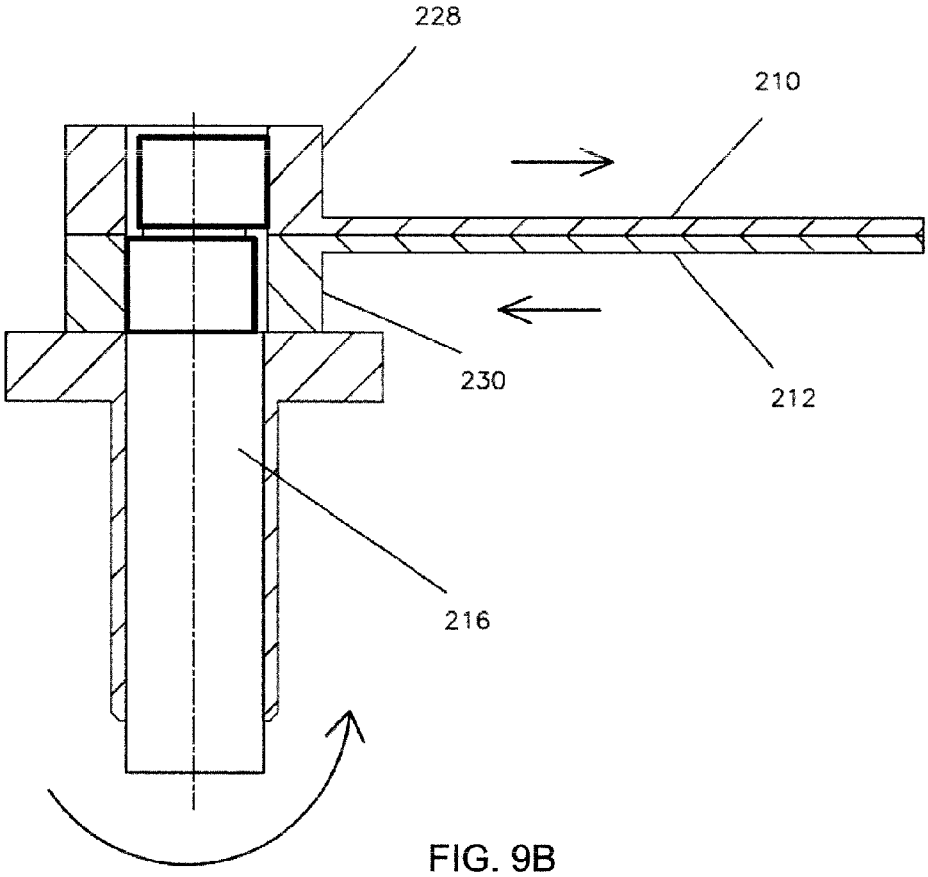
FIG. 9B shows a cross-sectional view of the cam and sliding plate arrangement of FIG. 9A.

As shown in FIG. 9B, two cam bushes (228 and 230) can be welded onto the sliding sheets 210 and 212 respectively in a manner known to a person skilled in the art. The sliding sheets (210 and 212) move forward and return back to home position positively while operating the cam (216) clockwise and anticlockwise respectively for separation of caps and bodies of the capsules. The cam (216) can be a double eccentric cam operating two sliding sheets (210 and 212). The device capacity can be preferably 300 capsules per cycle.

The sheet component (206) can be fastened to the base frame (202) with screws from sides keeping the top surface of the sheet component (206) free to mount the capsule loading tray assembly (300). Further, the sheet component (206) can be provided with locating holes (234) for locating and accommodating capsule tray lifting pins (312). Thus, the sheet component (206) can be used in both hand held and bench top assembly for filling capsules.

Figure 10:
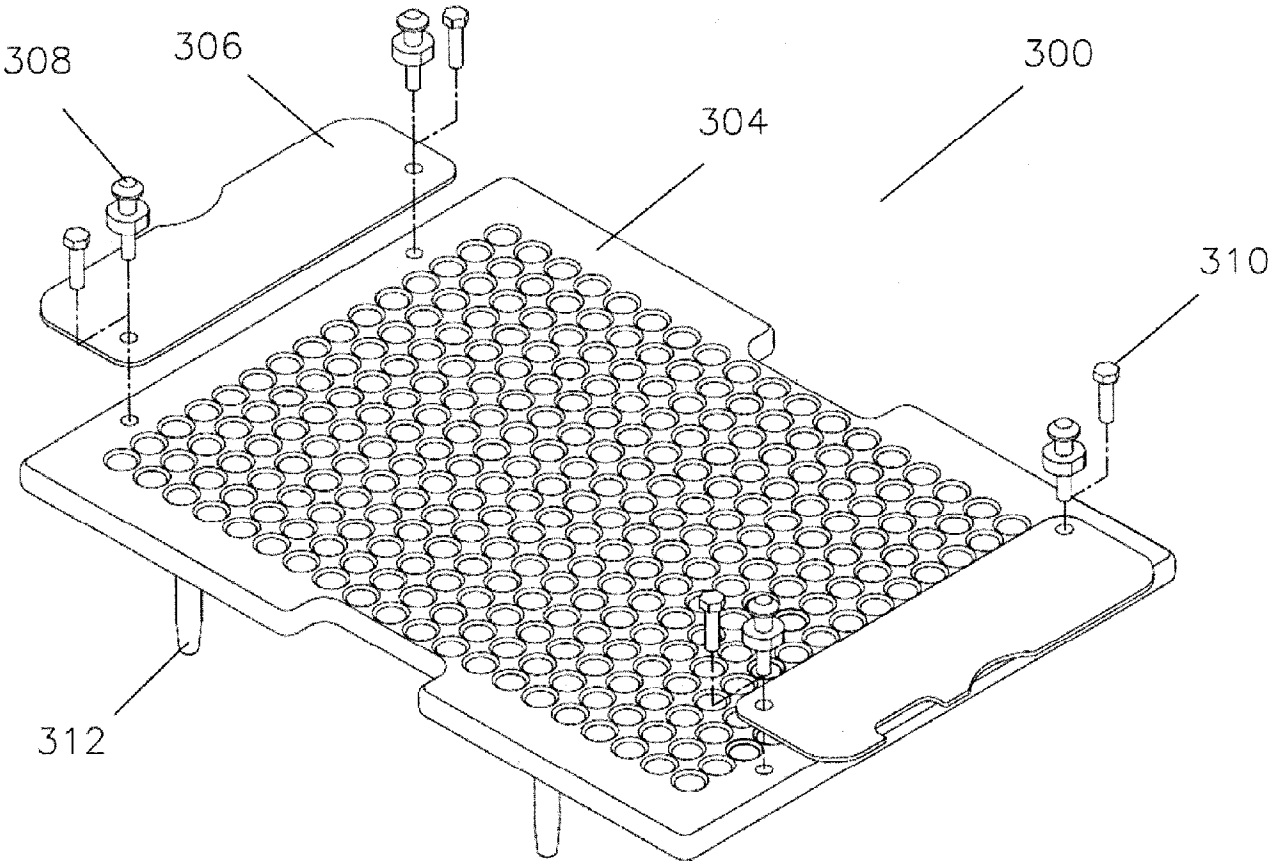
FIG. 10 shows the exploded view of capsule loading tray assembly according to the present invention.
Figure 10A:
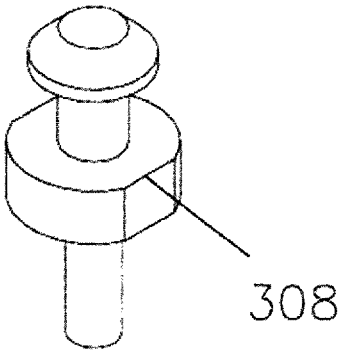
FIG. 10A shows a locating stud of the present invention.

In another embodiment, the present invention discloses a capsule tray assembly (300) (FIG. 10) that can be used with both hand-held and bench top filling machine. The capsule tray assembly (300) has a capsule tray or capsule-loading tray (304) having a plurality of holes preferably 300 or more in number for accommodating capsules. A pair of handles (306) can be detachably attached to the capsule tray (304) individually to the holes provided on either sides of the capsule tray (304) as illustrated in FIG. 10. Two sets of detachable locating studs (308) (FIG. 10A) are provided that can locate the locating holes (108) on the orienter base. The locating studs (308) can be used for detachably attaching the handle (306) to the capsule tray (304). The capsule tray (304) can be provided with two sets of detachable screws (310) that can replace the locating studs (308) while the capsule tray is used on a bench top Orienter. Thus, the capsule tray (304) can be used in both hand held and bench top assembly for orienting and filling capsules.

Figure 6:
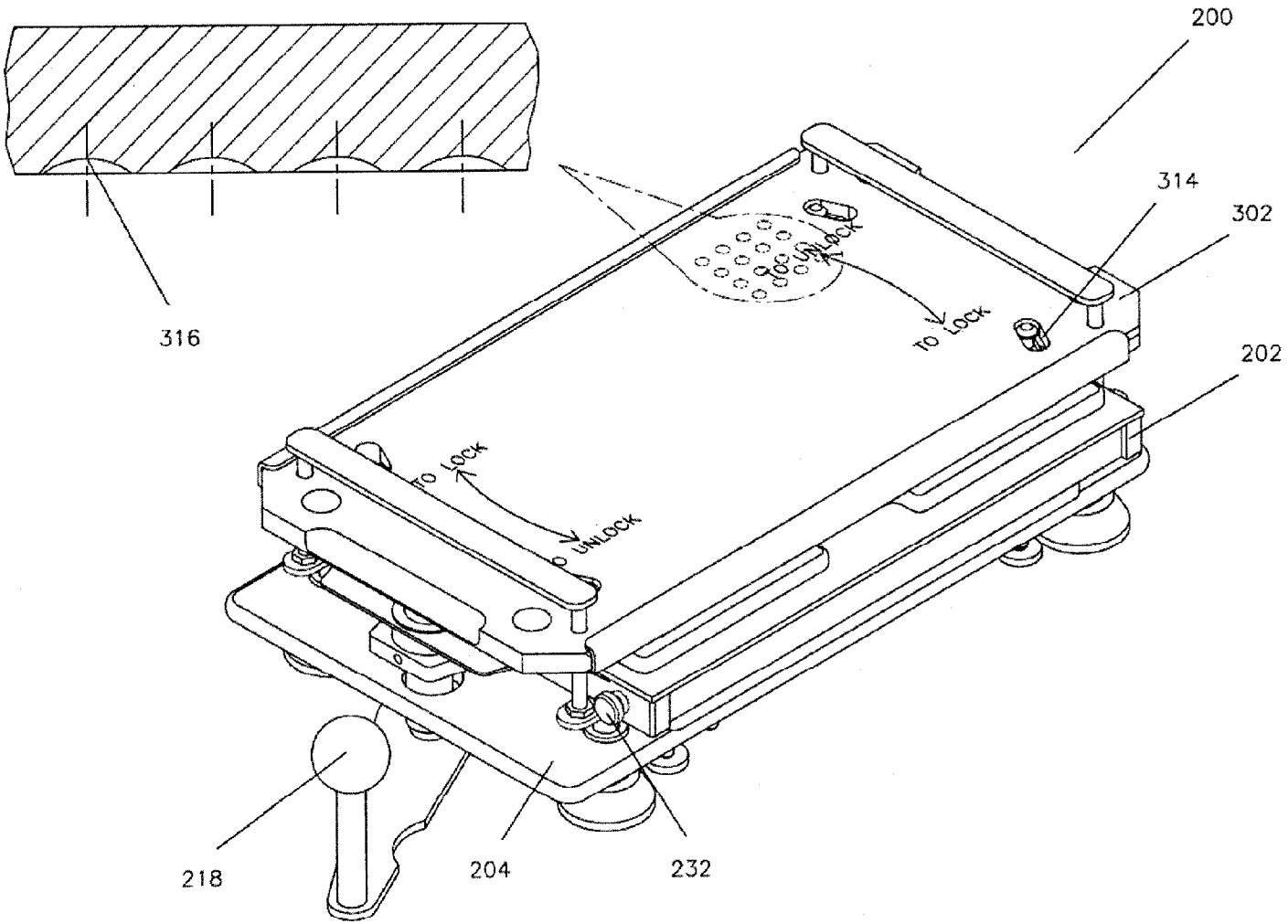
FIG. 6 shows an isometric view of a handheld filler assembly according to the present invention.
Figure 6A:
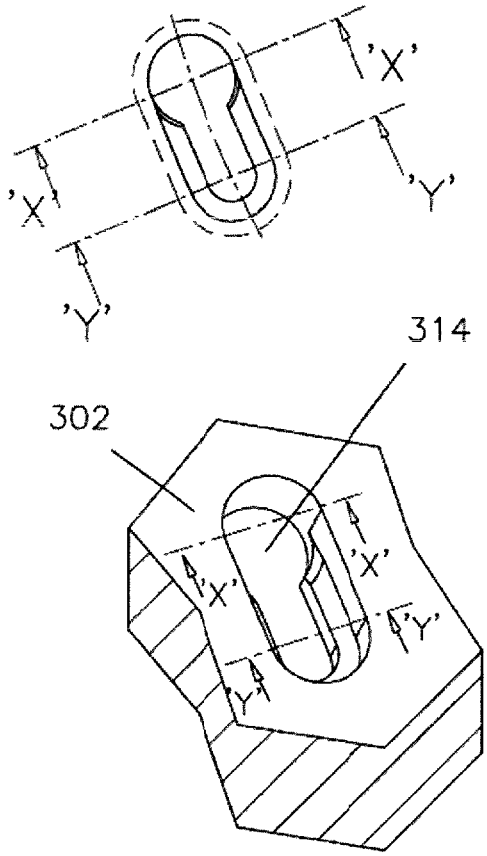
FIG. 6A shows the engagement of a locating stud and a locking plate profile cut slot with step according to the present invention.
Figure 6C:
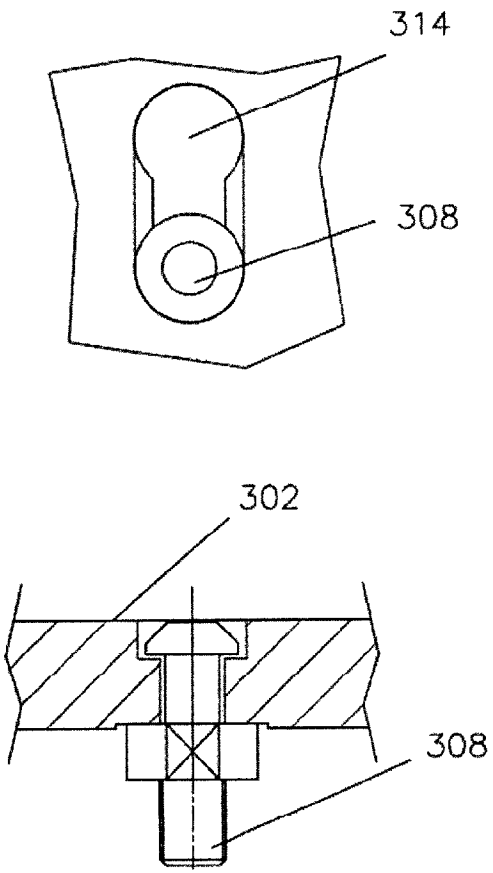
FIG. 6C shows a cross-sectional view of the engagement of FIG. 6A along Y-Y.
Figure 6B:
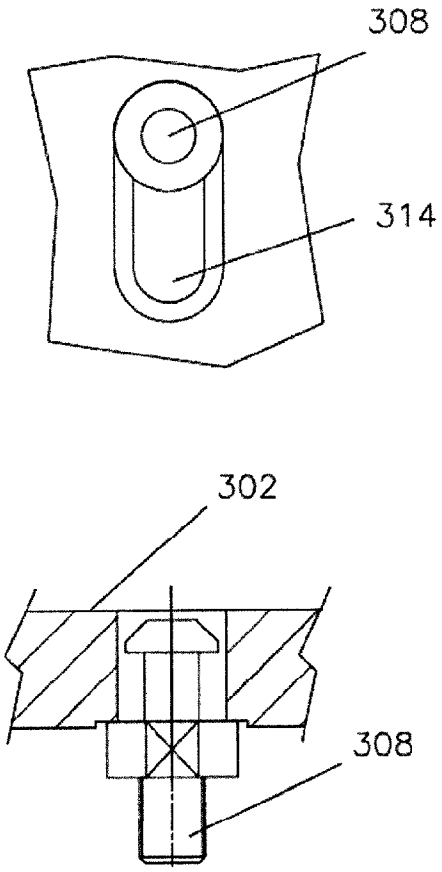
FIG. 6B shows a cross-sectional view of the engagement of FIG. 6A along X-X.
Figure 7:
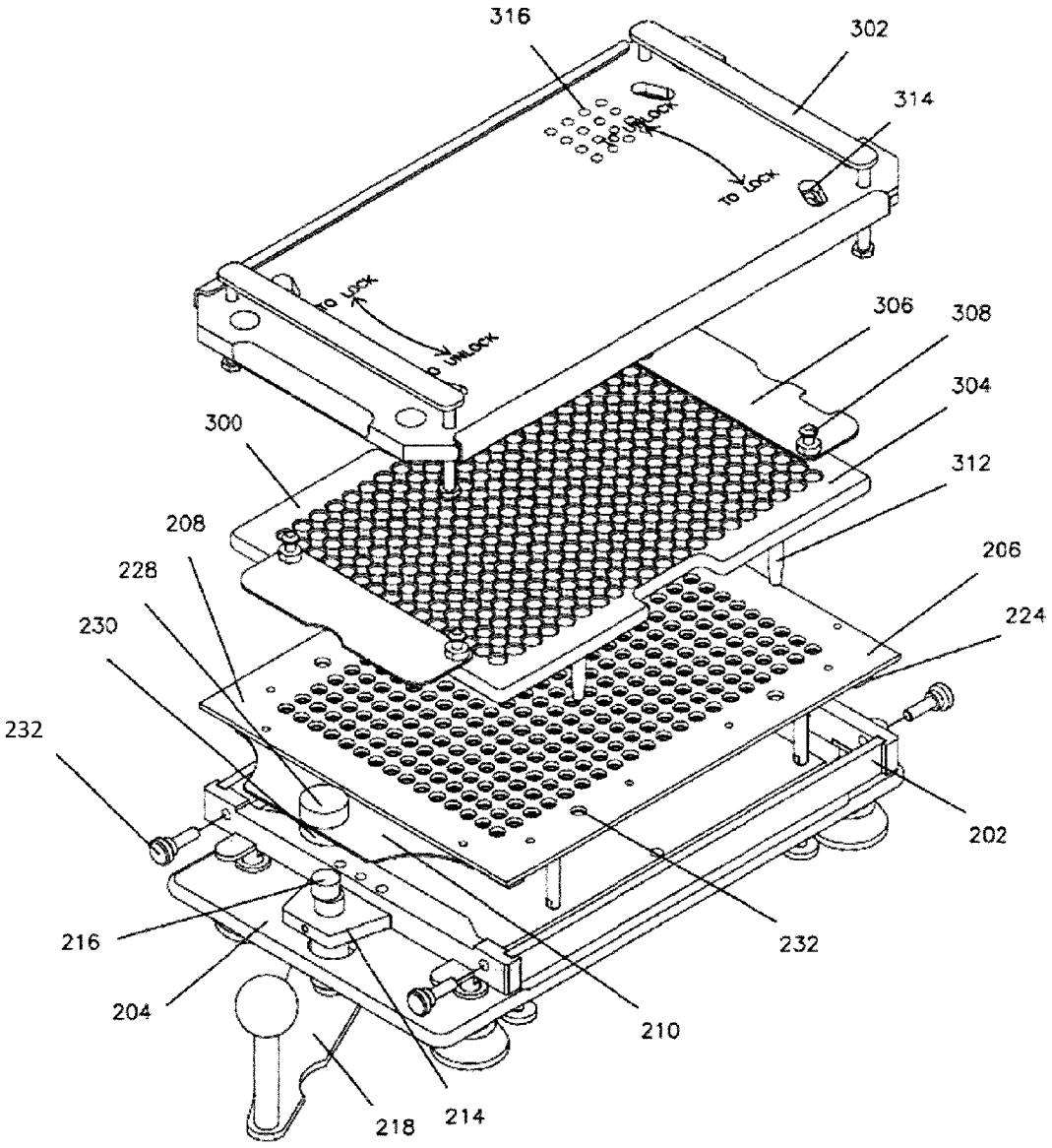
FIG. 7 shows an exploded view of a handheld filler assembly according to the present invention.
Figure 7A:
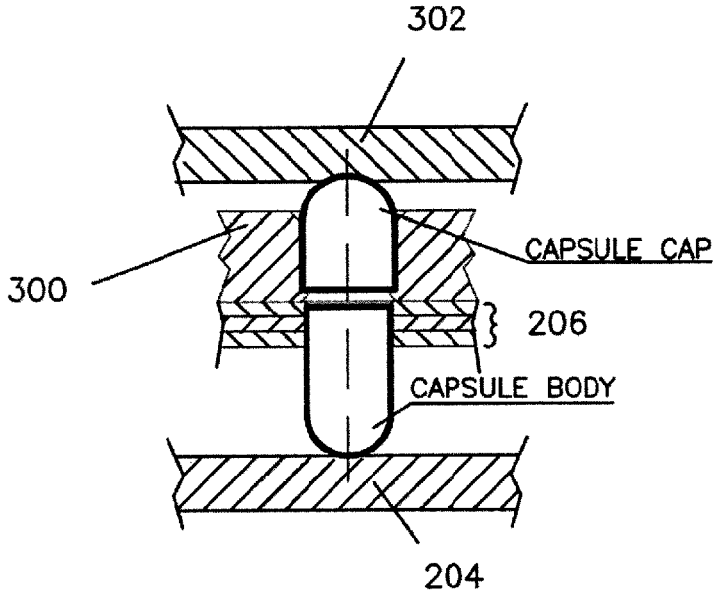
FIG. 7A shows a capsule body entering in a capsule cap with the help of a lifting plate of the present invention.

The locking plate (302) can be provided with locking plate profile cut slot with step (314) that can lock the detachable locating studs (308) of the capsule tray (FIG. 7) making it suitable for use in a hand held filler assembly. The locking plate (302) can thus be locked and unlocked by locating studs (308) by rotating the locking plate profile cut slot with step (314) in clockwise and counterclockwise direction as shown in FIGS. 6A-6C. The locking plate (302) can be provided with plurality of domes (316) on the bottom surface of the locking plate (302). The domes (316) prevent the denting of the dome of capsule during locking of filled capsules.

The capsule tray (304) further includes lifting pins (312) at the four corners at the bottom surface of the capsule tray (304). The lifting pins (312) can be used to locate the capsule tray (304) on the sheet component (206) on filler assembly (200) for filling capsules. The sheet component (206) can be provided with the locating holes (234) for locating the lifting pins (312) on the capsule tray. Thus, the capsule tray assembly (300) can be used interchangeably between both hand held and bench top filler.

It is an advantage of the assembly for filling capsules of the present invention having change parts common between benchtop and hand held version. The sheet component (206) and the capsule tray assembly (300) can be used in hand held machine when the customer has small volume of production. With the increase in volume of production, the customer can have the liberty to switch to bench-top machines with the same interchangeable change parts.

Figure 13:
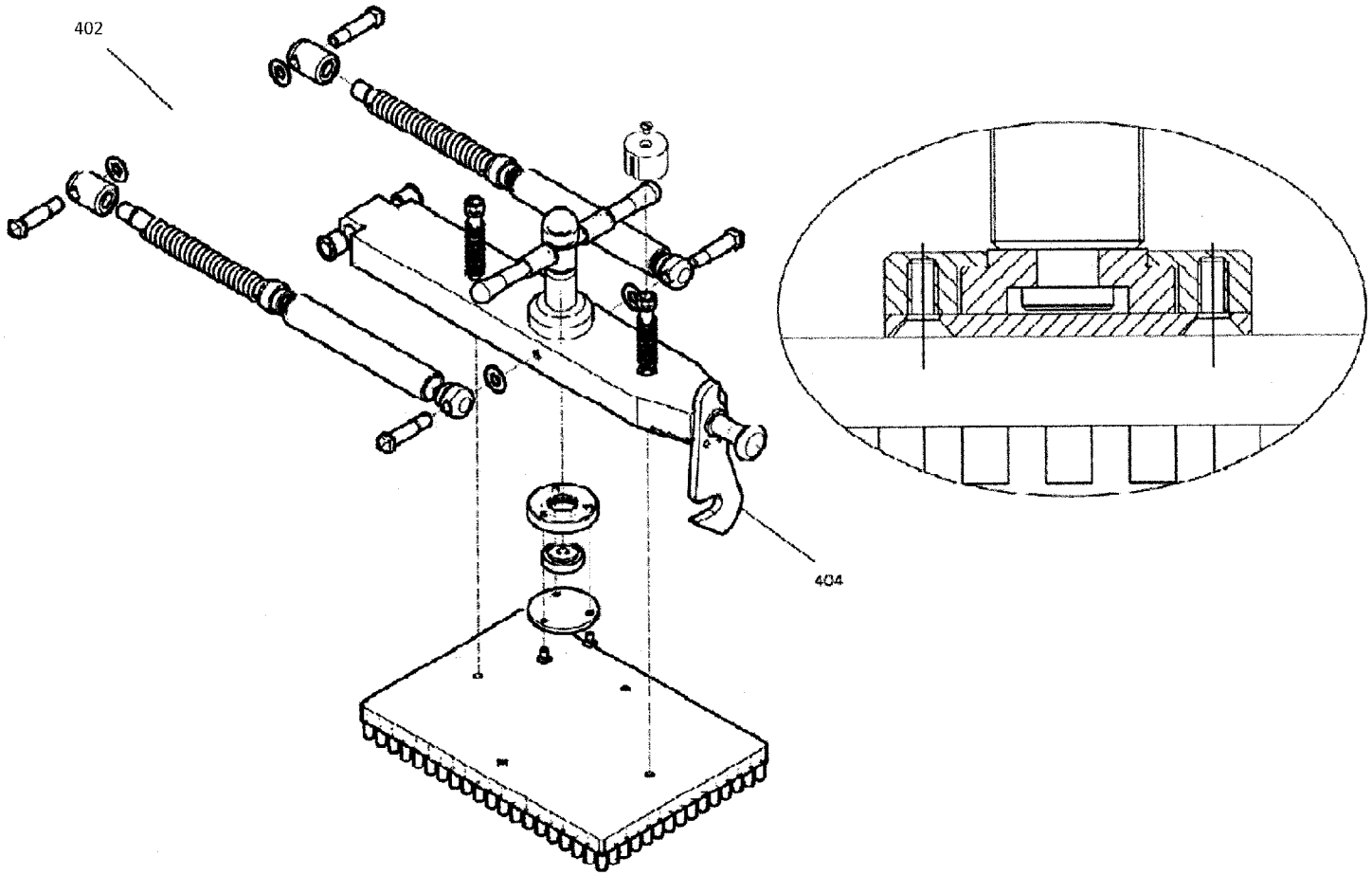
FIG. 13 shows an exploded view of a tamper plate assembly with self locking C-Clamp according to the present invention.

Another embodiment of the present invention discloses a bench top filling machine (400) having interchangeable change parts including the sheet component (206) and the capsule loading tray assembly (300) as shown in FIGS. 11A-11B and 12A-12B. The bench top-filling machine (400) further includes a tamper unit assembly (402) with self-locking C-clamp (404) for locking the tamping unit (FIG. 13).

The C-clamp (404) can be pivoted to tamper unit (402) using the pivot pin (412) to enable horizontal movement, preferably in a circular path. The C-Clamp (404) can be dimensioned suitably just to allow the C-Clamp groove (410) for locking the tamper unit (402) to enter the bolt provided on bench-top filling machine (400) base frame (414), making the C-Clamp (404) self-locking. The C-Clamp (404) remains in lower position, enabling the locking of tamping unit (402) due to the tare weight of the C-Clamp (404).

Figure 11A:
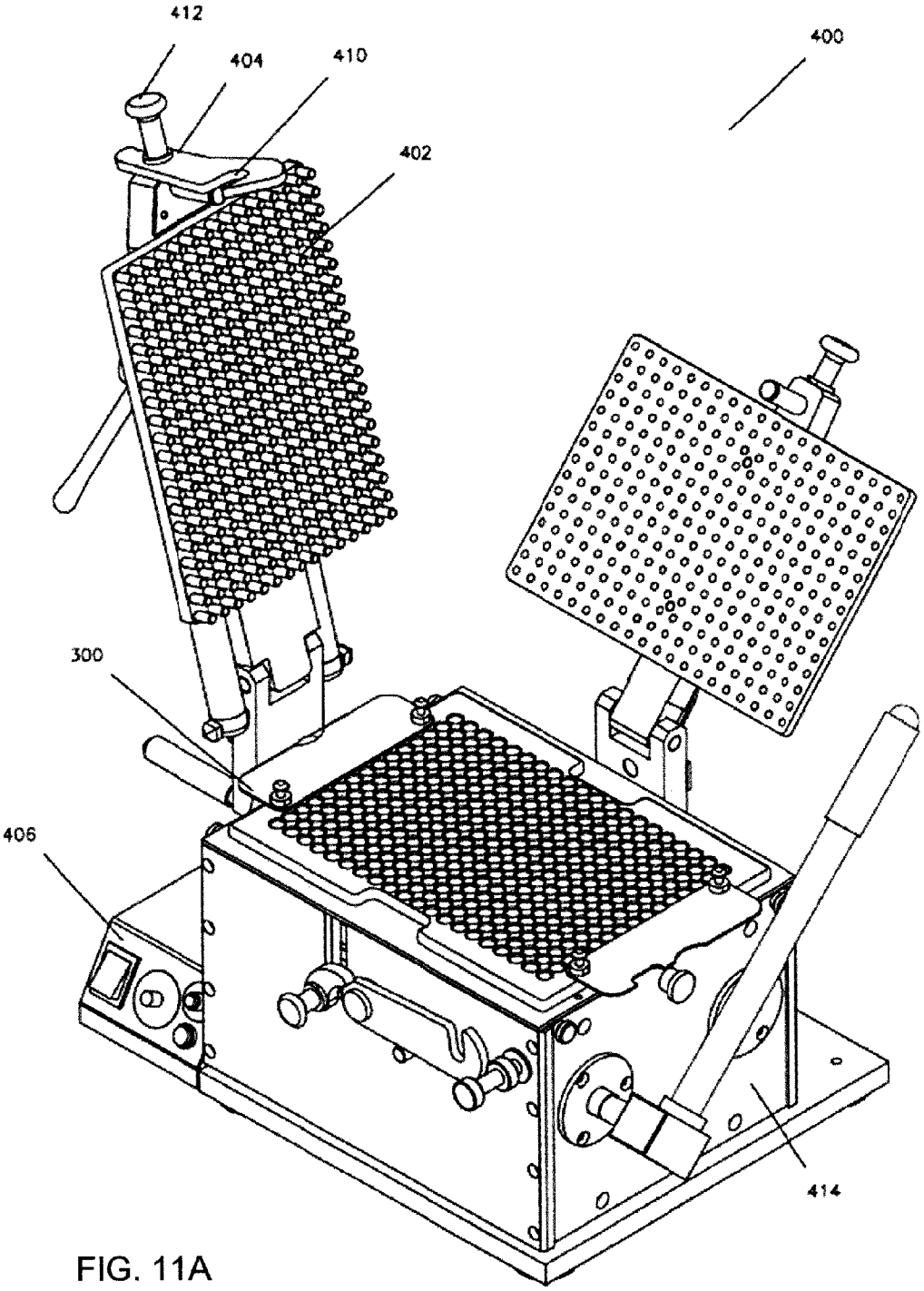
FIG. 11A shows an isometric view of a bench-top filler assembly with vibrator according to the present invention.
Figure 11B:
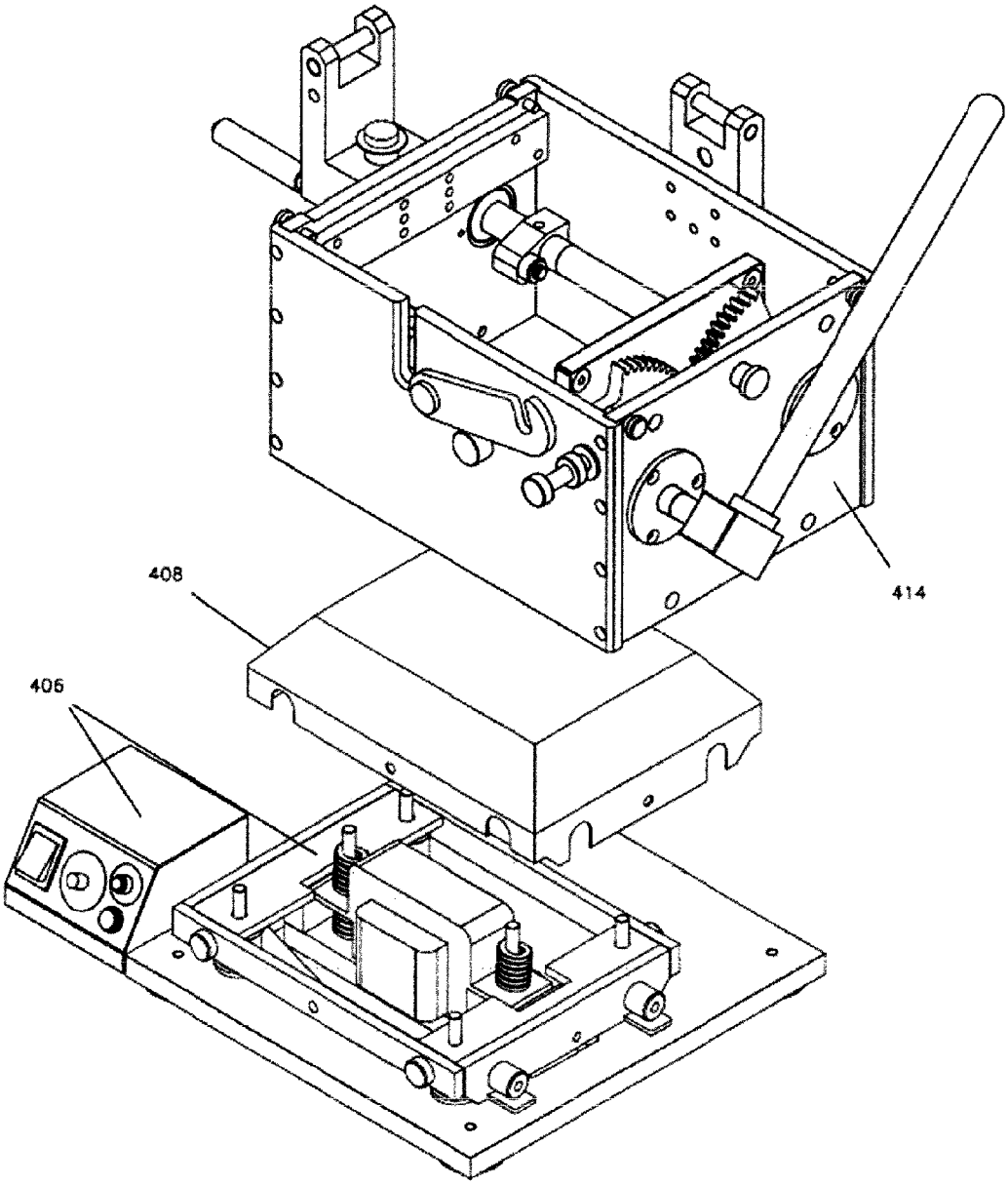
FIG. 11B shows the exploded view of the bench-top filler assembly of FIG. 11A.
Figure 12A:
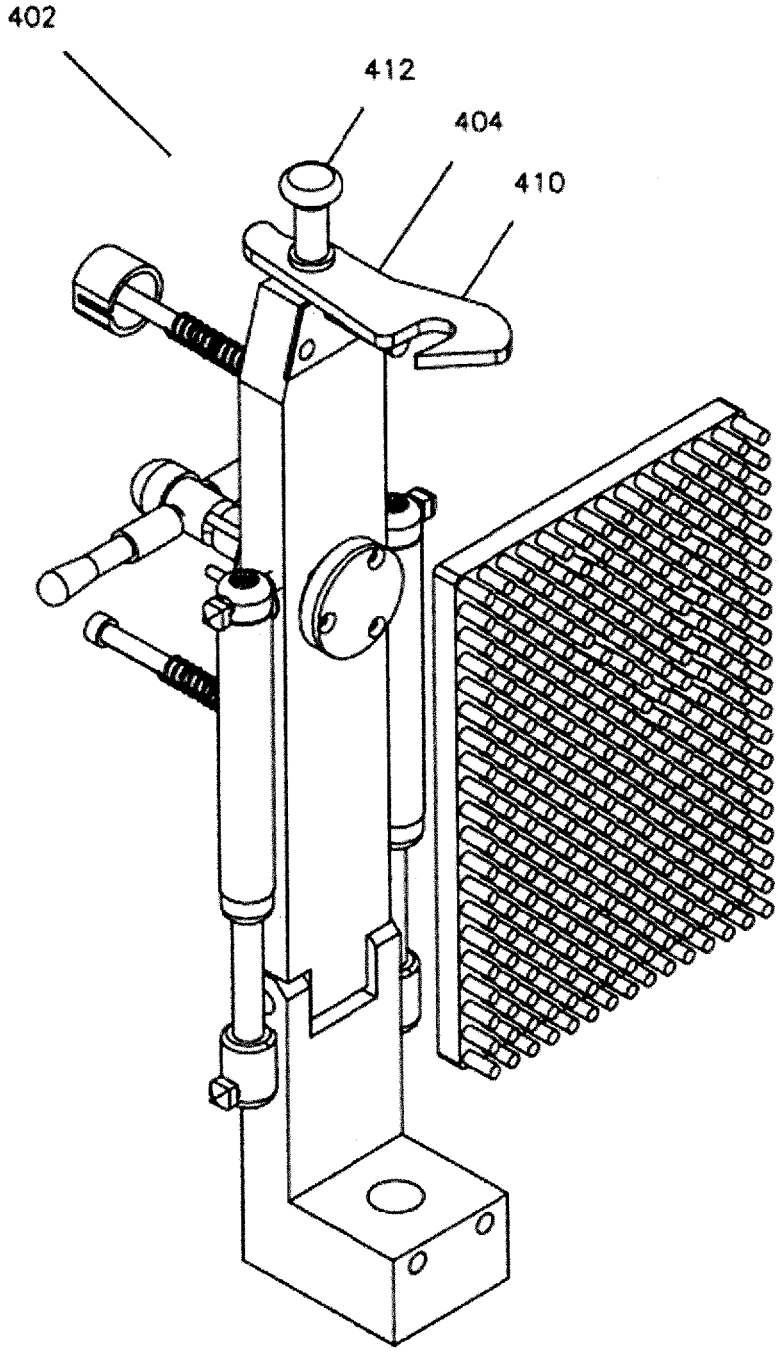
FIG. 12A shows an isometric view of a tamper plate assembly according to the present invention.
Figure 12B:
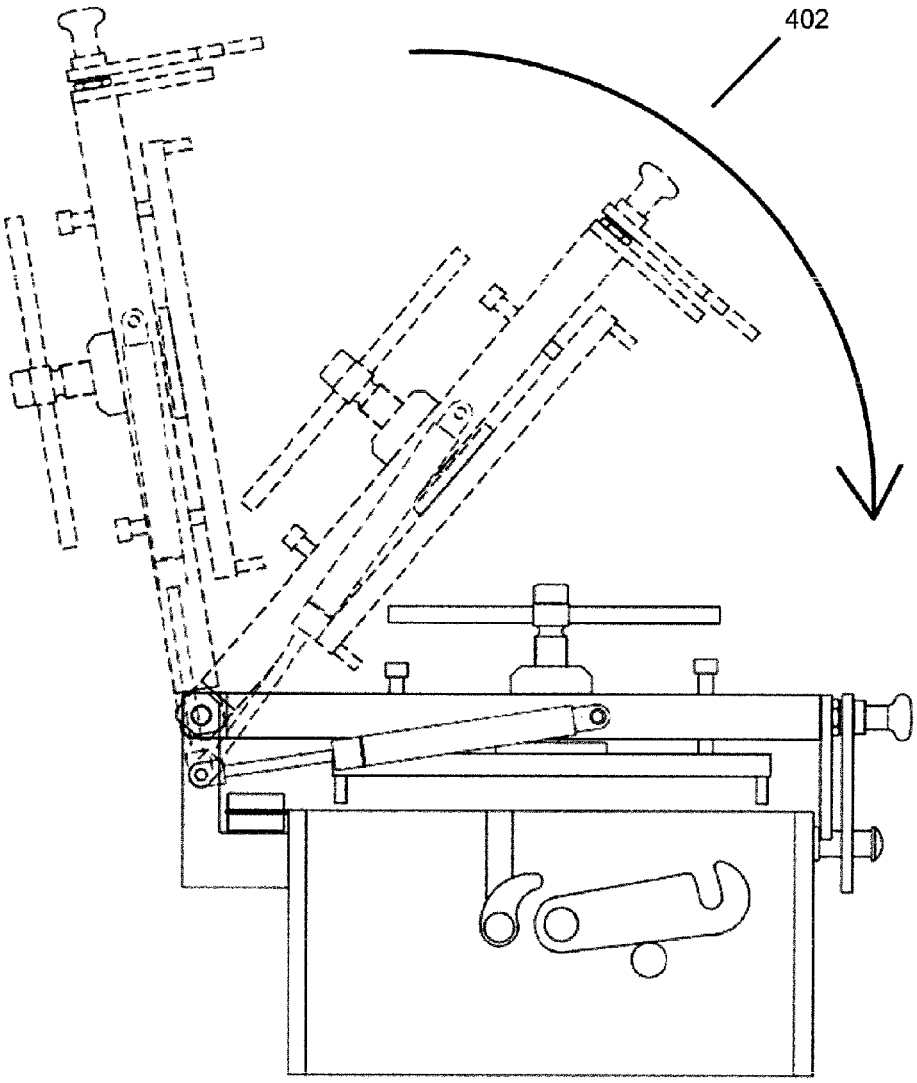
FIG. 12B shows a side view of the tamper plate assembly of FIG. 12A.

The bench top-filling machine (400) can further include a vibrator (406). The vibrator (406) can be provided with a vibrator cover (408) that protects the electronic parts of the vibrator (406) as shown in FIG. 11B. Similarly, other electrical parts of the bench top-filling machine such as for example the gear can be protected with a gear cover.

Figure 14:
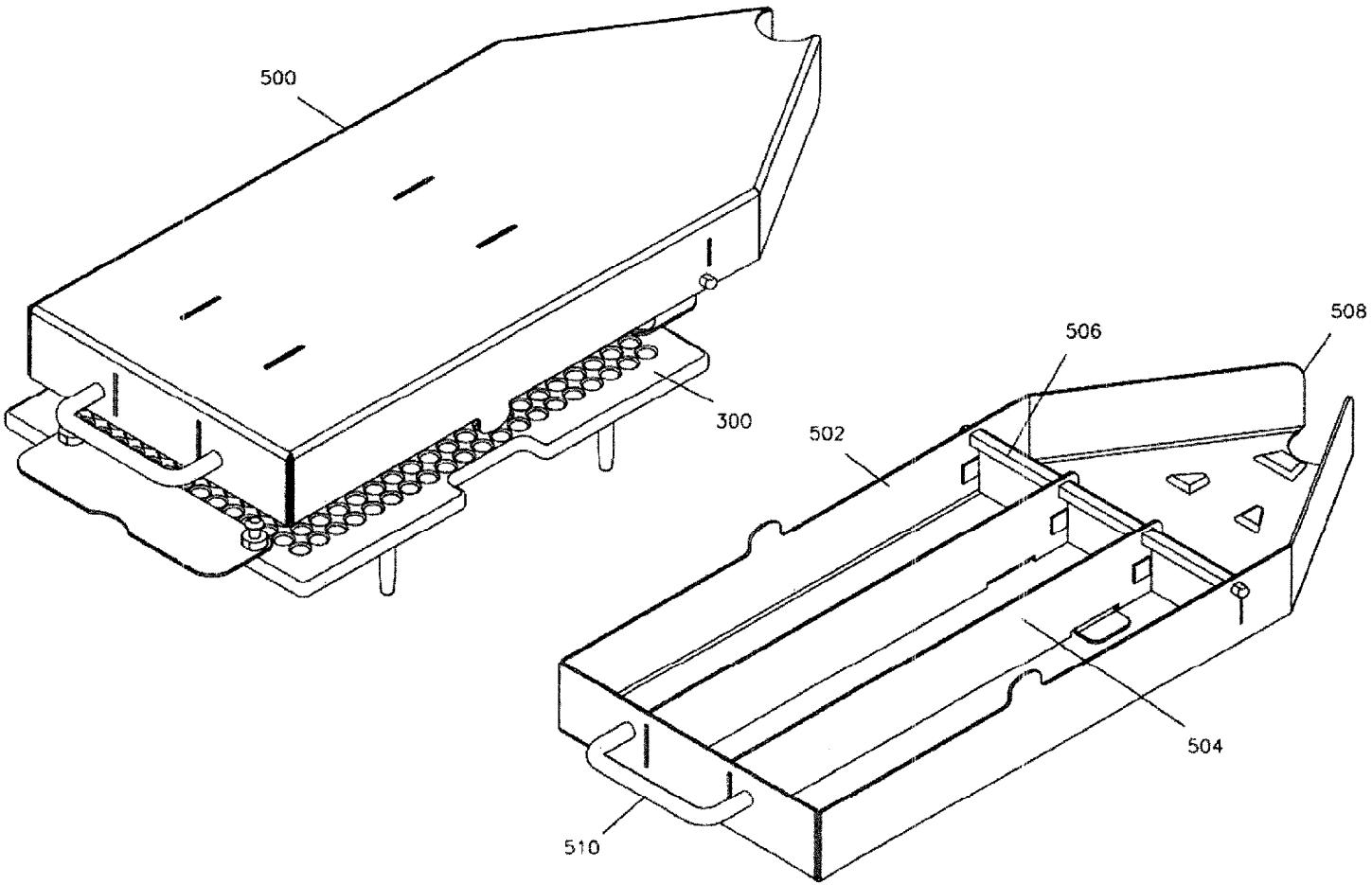
FIG. 14 shows an isometric view of a capsule counter according to the present invention.
Figure 15:
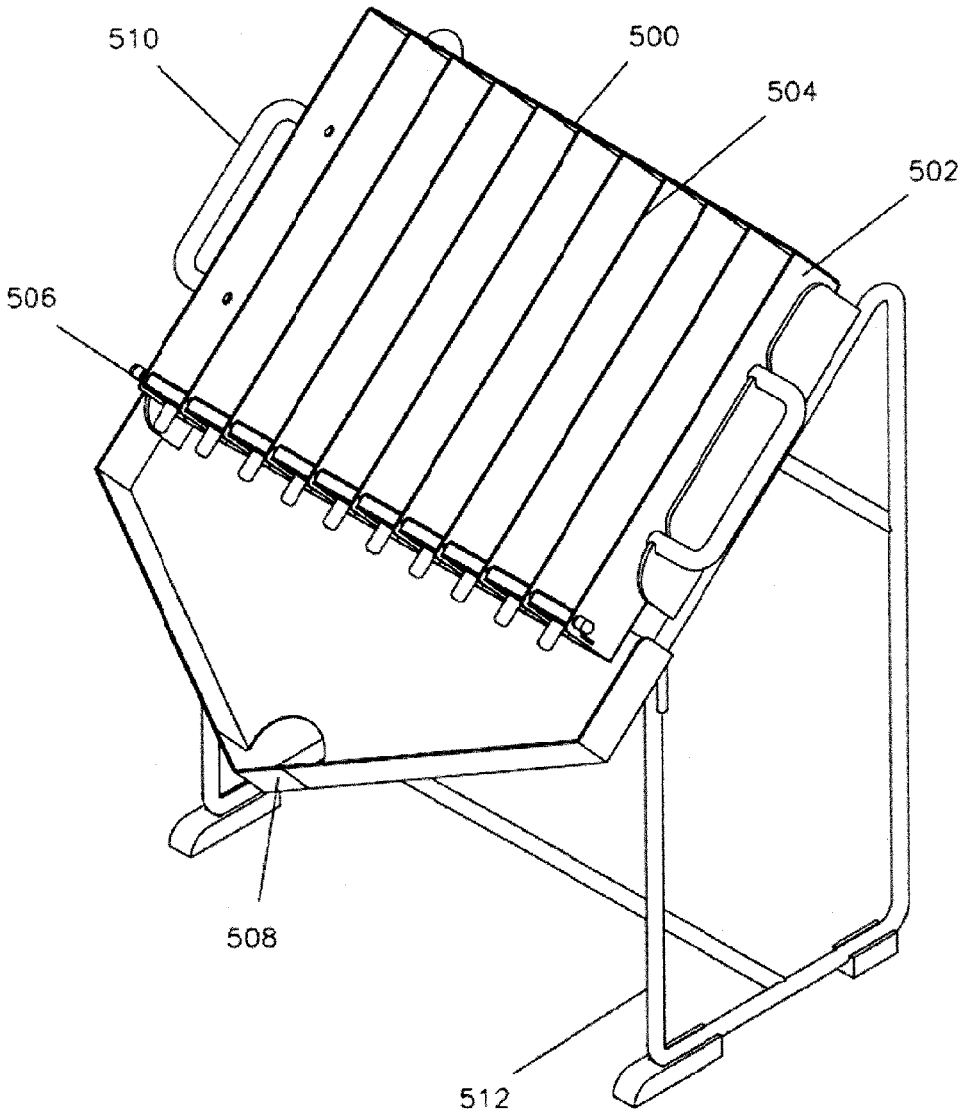
FIG. 15 shows an isometric view of a capsule counter with a stand according to the present invention.

In another embodiment of the present invention, the bench top-filling machine (400) can further include a capsule counter (500) (FIG. 14). The capsule counter (500) can separate the locked capsules into a predetermined quantity required for packing in a container as per the requirement say for example 30 capsules, 60 capsules or 100 capsules. It saves time of counting the capsules to be packed. As shown in FIG. 14, the capsule counter (500) has a tray (502) having plurality of compartments (504) to hold pre-determined number of capsules. A door (506) can be provided in front of each compartment (504) that can be opened for releasing the counted capsules into a chute (508). The chute (508) is funnel shaped and a container can be used to collect the predetermined number of capsules through the chute (508). The capsule counter (500) can be further provided with a handle (510) for holding the capsule counter (500) while handling. A stand (512) can be provided for holding the capsule counter in a position while transferring the predetermined number of capsules to a container (FIG. 15).

The capsule counter (500) can be adapted to locate the capsules on capsule loading tray (300).

The filled capsules on capsule loading tray (300) are locked on the filler. The capsule counter (500) can be positioned upside down on capsule loading tray (300) such that the each compartment (504) is between two rows or columns of locked capsules. Once the capsule counter (500) is turned along with capsule loading tray (300), the predetermined number of filled and locked capsules get collected in respective compartment (504) to be collected in container through chute (508) provided in capsule counter (500).

It is understood that the invention is not limited to the embodiments set forth herein for the purpose of exemplification, but is to be limited only by the scope of the attached claims including the full range of equivalency to which each element thereof is entitled.

The invention claimed is:

1. An improved device for filling soluble containers comprising:

an assembly for orienting a plurality of capsules;

an assembly for filling capsules, the assembly for filling capsules comprising:

a sheet component for holding a body portion of capsules thereby facilitating separation of a body portion and a cap portion of the capsules resulting in separated capsules, a base component for supporting a body portion of the separated capsules, and a capsule tray having a first set of holes to detachably attach a locating stud;

wherein the sheet component comprises a top sheet and at least two sliding sheets, a first sliding sheet located below the top sheet and adapted to move relative to the top sheet;

and a second sliding sheet located below the first sliding sheet and adapted to move relative to the first sliding sheet;

wherein each of the sheets has a plurality of holes therein to allow passage of capsules therethrough for holding a portion of each of the capsules for facilitating separation into the body portion and the cap portion;

the top sheet having a spacer with groove fastened on its bottom surface such that the sliding sheets move within the groove;

the sheet component fastened to the base component; and the base component comprising a displacement means for effecting relative movement of the sheets wherein the displacement means is a cam assembly mounted to the base component; and a locking plate, wherein the locating stud locates a second set of holes located in the locking plate.

2. The device according to claim 1, wherein the sheet component is provided with locating holes for locating and accommodating the capsule tray.

3. The device according to claim 2, wherein the capsule tray further comprises lifting pins for locating the locating holes provided on the sheet component of the assembly for filling capsules.

4. The device according to claim 1, wherein the sheet component is adapted for a hand held assembly for filling capsules.

5. The device according to claim 1, wherein the sheet component is adapted for bench top assembly for filling capsules.

6. The device according to claim 1, wherein a detachable screw is provided to replace the locating stud for use of capsule loading tray on a bench-top orienter.

7. The device according to claim 6, wherein the capsule tray is adapted to a bench top orienter.

8. The device according to claim 6, wherein the capsule tray is adapted to a bench top assembly for filling capsules.

9. The device according to claim 1, wherein the locking plate further comprises a plurality of domes on the bottom surface.

10. The device according to claim 1, wherein the second set of holes comprises a profile cut slot for locking a capsule tray.

11. The device according to claim 1, wherein the capsule tray is adapted to a hand held orienter.

12. The device according to claim 1, wherein the capsule tray is adapted to a hand held assembly for filling capsules.

* * * * *